United States Patent [19]

Church et al.

[11] 4,060,230

[45] Nov. 29, 1977

[54] EMBOSSING GATE ROLLER

[75] Inventors: Wayne Edward Church, Longmont; Frederick Fenn Quist, Jr., Boulder, both of Colo.

[73] Assignee: International Business Machines Corporation, Armonk, N.Y.

[21] Appl. No.: 741,099

[22] Filed: Nov. 11, 1976

[51] Int. Cl.[2] ..... B65H 29/00

[52] U.S. Cl. ..... 271/63; 271/DIG. 2; 271/174; 271/244

[58] Field of Search ..... 271/63, 174, DIG. 2, 271/243, 244, 188, 209; 118/60, 245; 432/60

[56] References Cited

U.S. PATENT DOCUMENTS

| | | | |
|---|---|---|---|
| 2,211,766 | 8/1940 | Brown | 271/63 R X |
| 3,749,398 | 7/1973 | Fujita | 271/188 X |
| 3,820,889 | 6/1974 | Nitanda | 355/3 R |

OTHER PUBLICATIONS

Japanese Published Patent Application No. 49-31336, 8-21-74, Masayoshi Furuichi.

*Primary Examiner*—Richard A. Schacher
*Attorney, Agent, or Firm*—Charles E. Rohrer

[57] ABSTRACT

In a document copier machine wherein an image is placed on a drum and transferred to copy paper, an embossing gate roller which places a small embossed section in the leading edge of copy paper so that the embossed section stands away from the surface of the drum to allow a stripper to coact with the copy paper and remove it from the drum.

8 Claims, 5 Drawing Figures

EMBOSSING GATE ROLLER

This invention relates to document copier machines and more particularly to a mechanism for feeding copy paper to the transfer station in an electrophotographic copy machine.

BACKGROUND OF THE INVENTION

In the electrophotographic copy process, copy paper is fed from a paper bin to a transfer station where the copy paper is mated with a surface carrying a developed electrostatic image of the original. At the transfer station, the electrostatic image is transferred to the copy paper and thereupon the copy paper is stripped away from the imagebearing surface. One of the problems of providing a reliable electrophotographic machine is the problem of reliably stripping copy paper from the image-bearing surface. Factors creating difficulty in stripping paper include the fact that the paper bears an electrostatic attraction to the image-bearing surface and therefore is to an extent electrically mated with that surface.

Many prior art electrophotographic machines utilize rotating drums as the image-bearing surface. If the copy paper is not stripped away from the drum, the paper wraps itself around the drum and creates a situation which generally requires the services of a specially trained repairman. Various types of strippers are found in the prior art including the provision of indentations in the drum surface at the leading edge of the copy paper so that gaseous fluid can be blown into the indentations at the proper time in order to create forces which push the paper away from the drum. Other detacking mechanisms used in the prior art include mechanical bars which ride on the surface of the drum and peel the paper away from the drum when the paper reaches the peeler bar. The first solution has difficulties which include the fact that indentations have to be placed in the drum, which include the fact that the paper has to be positioned directly over the indentations, and which include the expense of air-blowing machinery. The mechanical peeler bar solution has drawbacks in that it rides on the drum surface and tends to mar the area of the surface of the drum with which it is in contact. Consequently, it is generally required to lower the peeler bar to the surface of the drum for a short period of time and then remove it. Once again, therefore, it requires timing to place the peeler bar on the surface of the drum at the right instant to coact with the arrival of the copy paper. It is, therefore, the primary object of this invention to avoid the cost and the timing problems of the prior art solutions and provide a simple, cheap, reliable solution to stripping paper from the drum of an electrophotographic machine.

SUMMARY OF THE INVENTION

This invention relates to the provision of a roller positioned prior to the transfer station wherein the roller includes an embossing portion which forms a small section in the leading edge of the copy paper such that the embossed section cooperates with a stripper, after transfer, to provide positive stripping action of the paper from the drum. By providing the small embossed section in the leading edge of the copy paper, a mechanical stripper finger may be advantageously used since it may be positioned adjacent to, but not in contact with, the drum surface, and therefore does not mar the drum surface.

In the embodiment shown herein, one of a pair of gate rollers has an indented area into which the cooperating roller presses the copy paper as it leaves the gate, thereby providing the embossed leading edge in the copy paper.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION

Figure 1:
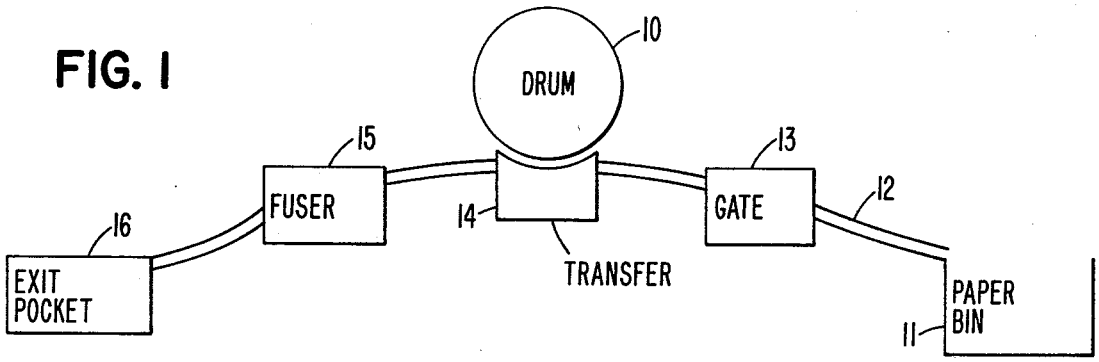
FIG. 1 shows a typical paper path in an electrophotographic machine.

FIG. 1 shows some of the elements in a typical paper path in an electrophotographic machine. In such a machine, the drum 10 carries a photoreceptive surface which is charged by a charge-producing device such as a corona and then variably discharged by light modulated in accord with the information contained on the document to be copied. That modulated light results in a modulated discharge of the photoreceptor such that when a developing material is applied to the photoreceptor, the material adheres in greater quantities to the less discharged parts of the photoreceptive surface. In that manner the drum 10 may be made to contain a developed image of the original. It is to that image that the copy paper is mated at the transfer station which is socalled since it involves the transfer of the developing material from the drum to the copy paper so that the copy paper then carries an image of the original. That developing material is then fused to the paper to complete the copy process and the paper is then provided to the user of the machine in a collator or exit pocket. FIG. 1 shows the elements of such a machine in regard to the path taken by the copy paper. Copy paper is stored in a paper bin 11 and supplied along the paper path 12 to a gate 13. In order to mate the leading edge of the copy paper to the leading edge of the image carried on drum 10, the gate 13 releases a sheet of copy paper at the right instant so that at transfer no information on the drum is lost. FIG. 1 shows the transfer station 14, the fuser 15, and the exit pocket 16. It is at the transfer station 14 that some mechanism must be provided to strip the copy paper away from the drum after the image has been transferred to the copy paper.

Figure 2:
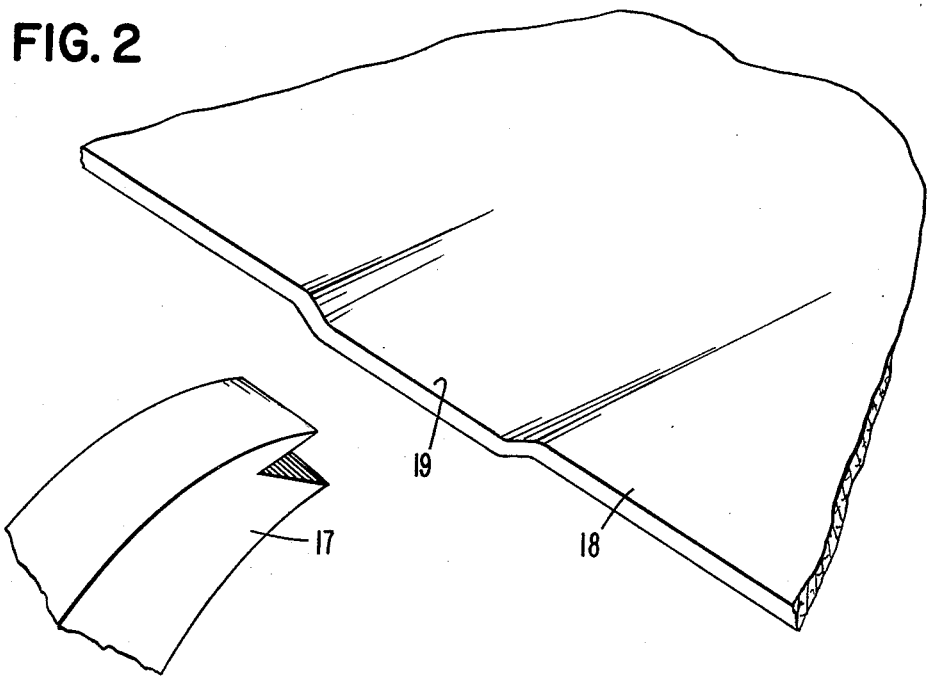
FIG. 2 shows the copy paper with the embossed leading edge and a mechanical stripper finger.

FIG. 2 shows a mechanical stripping finger 17 arranged to coact with the leading edge of copy paper 18 at a section 19 in which the copy paper is embossed. The embossed section 19 stands away from the drum and enables the mechanical stripper finger to reach under the copy paper and reliably detach it from the drum 10. Mechanical stripper finger 17 may be an apparatus such as disclosed in IBM TECHNICAL DISCLOSURE BULLETIN, Vol. 16, No. 9, Feb. 1974, p.

2953; or in IBM TECHNICAL DISCLOSURE BULLETIN, Vol. 19, No. 5, October 1976, pp. 1595–1596.

Figure 3:
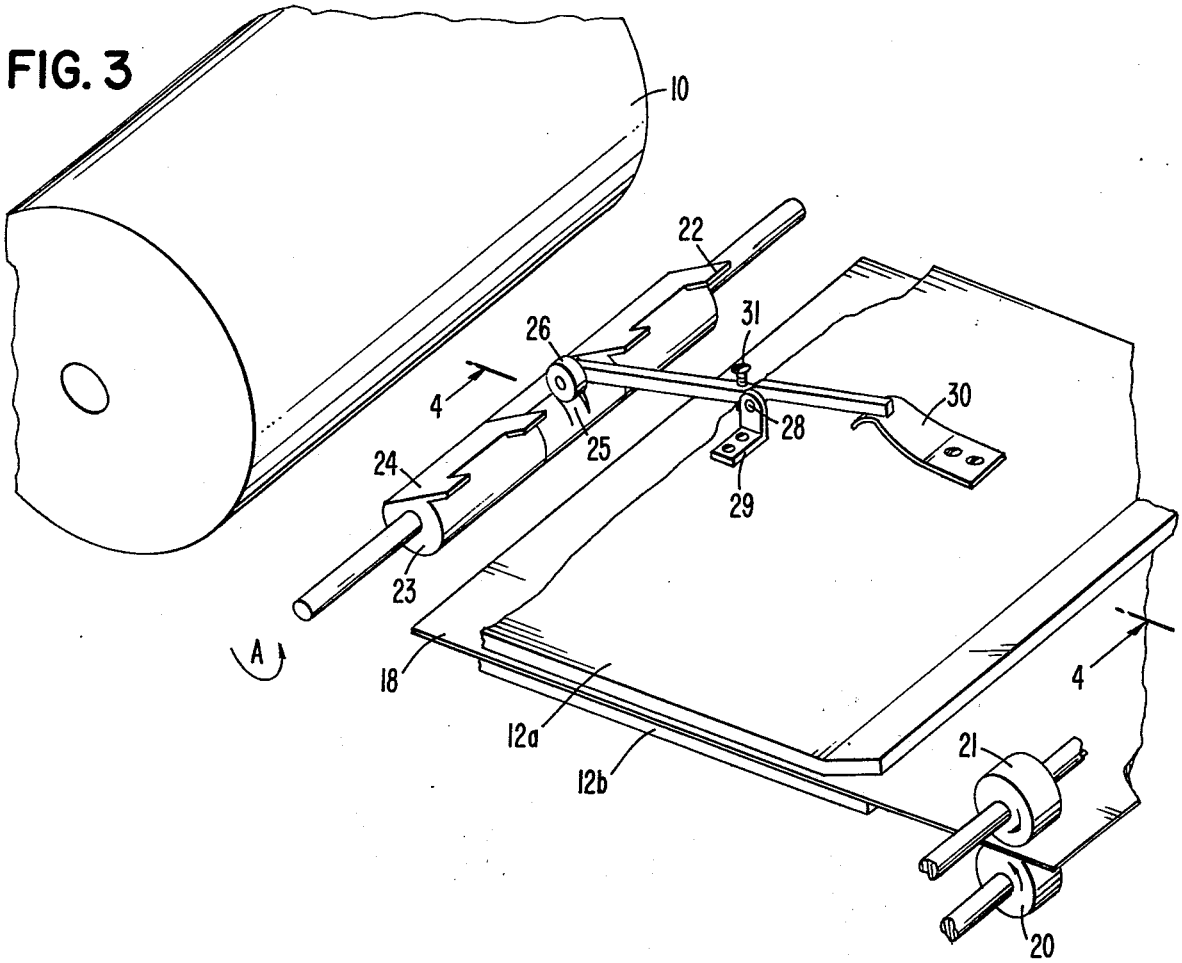
FIG. 3 shows a perspective view of the gate roller of the instant invention.
Figure 4A:
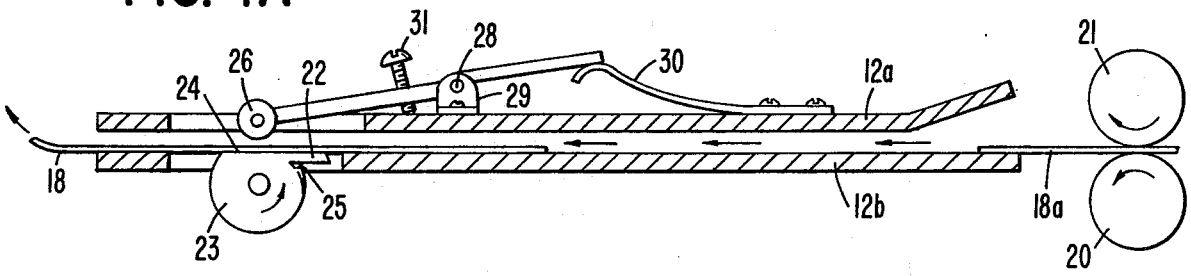
FIGS. 4A and 4B are planar sectional views taken along line 4—4 in FIG. 3, showing the action of the gate at different points in the cycle.
Figure 4B:
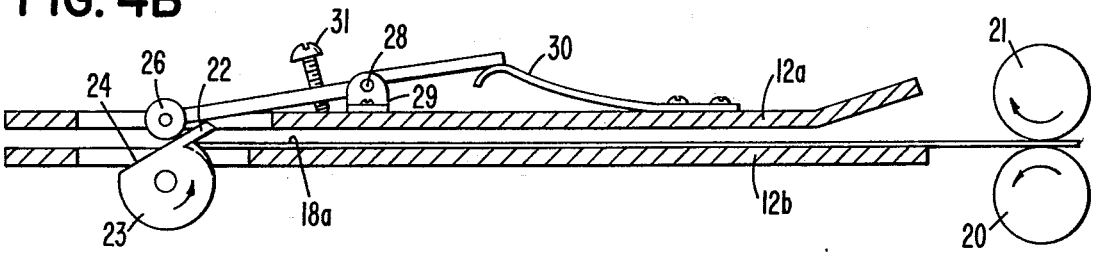

FIG. 3, 4A, and 4B are views of the embossing gate roller of this invention. Note that a copy paper 18 is shown in FIG. 3 approaching the embossing gate roller 23. Paper 18 is driven by rollers 20 and 21 until the leading edge of paper 18 reaches the gate fingers 22 which are a part of roller 23. This may be seen more clearly in FIG. 4B where copy paper 18*a* is shown positioned against the gate fingers 22. After positioning the paper against the gate fingers 22, rollers 20 and 21 are permitted to slip on the paper. At the proper instant in the cycling of the machine, embossing gate roller 23 is rotated in the direction shown by arrow A to allow the paper to advance to drum 10.

Referring particularly to FIG. 3, note that as the copy paper moves forward, roller 26 presses the leading edge of that copy paper into indentation 25 formed in roller 23. As a result, embossed section 19, shown in FIG. 2, is formed into the leading edge of the copy paper. Roller 26 is mounted on an arm 27 which is pivoted at 28 on bracket 29 and biased against roller 23 by a spring 30. FIGS. 3 and 4A also show a flat surface 24 on a portion of roller 23. Roller 23 is turned to that flat surface as shown in FIG. 4A, while the copy paper 18 continues to advance out of the gate area and through the transfer station. Adjusting screw 31 is provided to hold roller 26 away from flat surface 24. Once paper 18 has completed its journey past the gate, roller 23 is again positioned as shown in FIG. 4B to receive the next sheet of copy paper 18*a*. In that manner, the machine is ready for the next copy cycle in which copy paper 18*a* will mate with the succeeding image.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. In an electrophotographic machine wherein copy paper is moved from a supply area to a transfer station whereat an image of a document to be copied is transferred from an image-bearing drum to said copy paper through contact of said copy paper with said drum, apparatus including:

embossing means located prior to said transfer station in the path of said copy paper, for forming a small embossed section in the leading edge of said copy paper so that said small embossed section including a portion of said leading edge stands away from the surface of said drum when said leading edge is in contact with said drum; and stripper means for removing said copy paper from said drum, said stripper coacting with said embossed section of said copy paper.

2. The apparatus of claim 1 wherein said embossing means comprises a first roller with a small indentation therein and a second roller for pressing said paper into said indentation.

3. The apparatus of claim 2 wherein said first roller contains gate means for positioning the leading edge of said paper in a stationary position prior to the gate rotation which moves the copy paper and allows the embossing action to take place.

4. The apparatus of claim 3 wherein said first roller has a flat portion on the surface thereof so that upon gate rotation said first roller is rotated until said flat portion is facing said copy paper and further including adjustable means for holding said second roller out of contact with said first roller when said flat surface is facing said copy paper, whereby said copy paper passes through said first and second rollers.

5. The apparatus of claim 1 wherein said stripper means is a mechanical finger means, said finger means located close to said drum but not in contact therewith, said finger means in a location for being struck by said portion of said leading edge in said small embossed section so that said finger is moved thereby, said leading edge following the movement of said finger means.

6. The apparatus of claim 5 wherein said embossing means comprises a first roller with a small indentation therein and a second roller for pressing said paper into said indentation.

7. The apparatus of claim 6 wherein said first roller contains gate means for positioning the leading edge of said paper in a stationary position prior to the gate rotation which moves the copy paper and allows the embossing action to take place.

8. The apparatus of claim 7 wherein said first roller has a flat portion on the surface thereof so that upon gate rotation said first roller is rotated until said flat portion is facing said copy paper and further including adjustable means for holding said second roller out of contact with said first roller when said flat surface is facing said copy paper, whereby said copy paper passes through said first and second rollers.

* * * * *